US006000501A

United States Patent [19]

Evans

[11] Patent Number: 6,000,501

[45] Date of Patent: Dec. 14, 1999

[54] TORSION WINDER

[75] Inventor: David K. Evans, Albion, Ind.

[73] Assignee: White Consolidated Industries, Inc., Cleveland, Ohio

[21] Appl. No.: 08/903,057

[22] Filed: Jul. 30, 1997

[51] Int. Cl.[6] ..... F03G 1/08; E04F 10/06

[52] U.S. Cl. ..... 185/40 R; 135/88.12; 160/67; 160/302

[58] Field of Search ..... 185/40 R; 135/88.12; 160/67, 302

[56] References Cited

U.S. PATENT DOCUMENTS

| | | | |
|---|---|---|---|
| 1,482,191 | 1/1924 | Hornauer | 185/40 A |
| 2,088,094 | 7/1937 | Robarge | 29/228 |
| 2,750,185 | 6/1956 | Moore | 267/155 |
| 3,007,653 | 11/1961 | Becker | 242/375.1 |
| 3,708,859 | 1/1973 | Bitney | 29/430 |
| 4,142,283 | 3/1979 | Walker et al. | 29/227 |
| 4,211,401 | 7/1980 | Cunard | 185/40 B X |
| 4,287,429 | 9/1981 | Bashnin et al. | 290/40 C |
| 4,959,897 | 10/1990 | Ogawa et al. | 185/40 R |
| 5,150,770 | 9/1992 | Secci | 185/39 |
| 5,182,498 | 1/1993 | Stuhr | 185/40 R X |
| 5,213,181 | 5/1993 | Isaka | 185/39 |
| 5,390,763 | 2/1995 | Liedtke | 185/39 |
| 5,485,666 | 1/1996 | Welborn et al. | 29/436 |
| 5,732,756 | 3/1998 | Malott | 160/67 |

*Primary Examiner*—Allan D. Herrmann
*Attorney, Agent, or Firm*—Pearne, Gordon, McCoy & Granger LLP

[57] ABSTRACT

A method and apparatus for adding torsion to a roller tube assembly of a retractable awning which includes a roller tube rotatable about a rod and a torsion spring between the roller tube and the rod. The model number of the roller tube assembly and the required number of turns to obtain the desired torsion is input, by bar code scanner, into a programmable controller. The controller is preprogrammed with data relating to the proper holding assemblies required for various model numbers and boundaries for the data input by the bar code scanner. The controller first verifies that the proper holding fixture is present. The rod is coupled to a drive motor for rotation therewith and the roller tube is secured in the holding assembly to substantially prevent rotation thereof. The rod is coupled and the roller tube is secured solely by longitudinally moving the roller tube assembly into the holding fixture. The drive motor rotates the rod relative to the roller tube for the input number of revolutions to add the desired amount of torsion. The rod is then locked to the roller tube and uncoupled from the drive motor and the roller tube is removed from the holding fixture.

9 Claims, 12 Drawing Sheets

TORSION WINDER

BACKGROUND OF THE INVENTION

The present invention generally relates to awnings and, more specifically, to retractable awnings which include a torsion spring.

There are a number of known retractable awning assemblies which when mounted to a vertical wall create a sheltered area adjacent to the wall. A popular application of such awning assemblies is on the side of a recreational vehicle. The retractable awning assemblies can be divided into two general classes: box-type awnings and shifting-roll-type awnings. Box-type awnings have a rotating roller tube which is mounted to the wall. The awning is unrolled from the tube to an extended position and rolled onto the tube for storage. A box forms a stationary enclosure for the awning when stored. Shifting-roll-type awnings have a rotatable roller tube suspended between two support arms. The tube is moved laterally toward and away from the wall to unroll and roll the awning. One edge of the awning is attached to the wall and the other edge of the awning is attached to the tube. Both types of retractable awnings typically are spring balanced or biased with torsion springs to aid in rolling the awning on the roller tube.

Torsion springs effectively aid in rolling the awning on the roller tube when they have adequate torsion and substantially equal torsion at each end of the roller tube. Prior art methods for applying torsion to the springs, however, has often resulting in uneven or no torsion. The torsion have been typically applied with a hand crank while the operator manually counts the number of turns applied. The operator must physically hold the crank until a locking pin is inserted. This process is not only physically demanding but is also subject to many kinds of errors. For example, the operator can easily miscount the number of turns applied to the roller tube assembly or apply a number of turns intended for a different awning model. This is particularly true when the process is interrupted for a break or at the end of a shift. Accordingly, there is a need in the art for an improved method and apparatus for applying torsion to retractable awning assemblies.

BRIEF SUMMARY OF THE INVENTION

The present invention provides a method and apparatus which overcomes at least some of the above-noted problems of the related art. According to the present invention, a method of adding torsion to a roller tube assembly includes the steps of coupling an awning rod to a drive motor of a drive assembly and securing an awning roller tube in a holding assembly to substantially prevent rotation of the roller tube. The drive motor rotates the rod relative to the roller tube in a first direction for a predetermined number of revolutions to obtain the desired amount of torsion. The rod is locked to the roller tube to prevent rotation between the rod and the roller tube in a second direction opposite the first direction which would remove the torsion just obtained. Finally, the rod is uncoupled from the drive motor and the roller tube is unsecured from the holding fixture. Preferably, the drive motor is driven by a programmable logic controller which automatically rotates the drive motor a predetermined number of turns which is input into the controller. According to another aspect of the invention, the model of the roller tube assembly and or the required number of rotations is input into the controller by bar code scanner. According to yet another aspect of the invention, the controller is preprogrammed with the proper holding assemblies required for various models and verifies that the proper holding fixture is present before proceeding with the procedure.

A torsion winder according to the present invention includes a drive assembly including a drive motor, a holding assembly secured to the drive assembly, and a control system in communication with the drive motor. The holding assembly includes a coupler engageable with the rod to connect the rod to the drive motor for rotation therewith and a lock engageable with the roller tube to secure the roller tube against rotation. The control system includes a programmable logic controller for controlling the operation of the drive motor. Preferably, the lock has a spring-loaded tab so that the rod is coupled and the roller tube is secured solely by longitudinally moving the roller tube assembly into the holding fixture.

BRIEF DESCRIPTION OF THE SEVERAL VIEWS OF THE DRAWING

These and further features of the present invention will be apparent with reference to the following description and drawing, wherein.

DETAILED DESCRIPTION OF PREFERRED EMBODIMENTS

Figure 1:
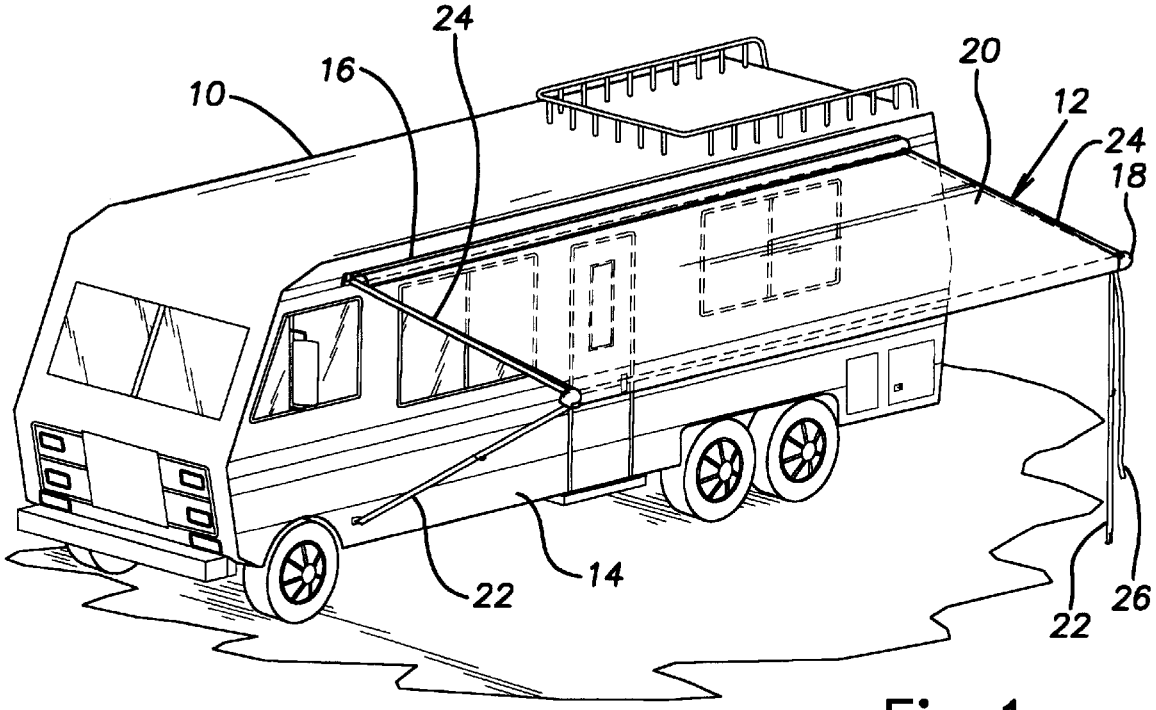
FIG. 1 is a perspective view of a recreational vehicle having a retractable awning secured thereto.

FIG. 1 illustrates a recreational vehicle 10 having a retractable awning assembly 12 mounted on a generally vertical side wall 14 thereof. The awning assembly 12 is movable between a stored position adjacent the side wall 14 of the recreational vehicle 10 and an extended position forming a shelter adjacent the side wall 14. The awning assembly 12 includes an awning rail 16 mounted on the side wall 14, a roller tube assembly 18, and a canopy or awning 20 rollable on the roller tube assembly 18. The awning 20 is made from vinyl, canvas, or other material known in the art. A trailing edge of the awning 20 is secured to the rail 16 and a leading edge is secured to the roller tube assembly 18. The awning assembly 12 also includes a pair of support arms 22 and a pair of tension rafters 24. Upper ends of the support arms 22 support the roller tube assembly 18 and lower ends are removably mounted on the side wall 14 or alternatively rested on a ground surface. The tension rafters 24 are disposed between the leading and trailing edges of the awning 20 to maintain the awning 20 in tension. Preferably, inner ends of the tension rafters 24 are pivotally connected to the side wall 14 and outer ends are slidably connected to the support arms 22. A pull strap 26 is rolled with the awning 20 and is used to unroll the awning 20.

Figure 2:
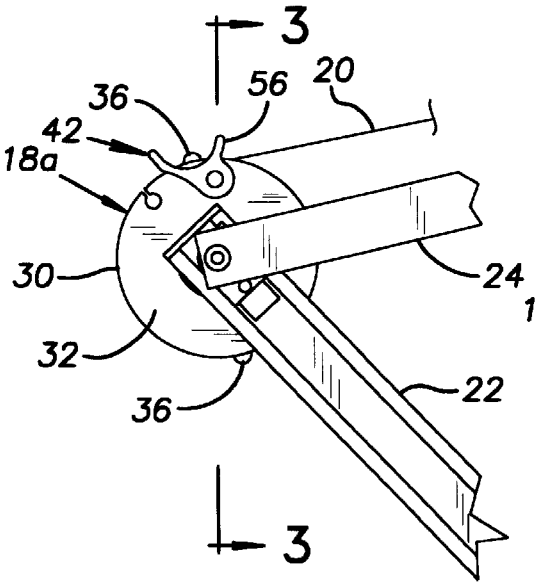
Fig.2 PRIOR ART
FIG. 2 is a side elevational view of a first roller tube assembly of the retractable awning of FIG. 1.
Figure 3:
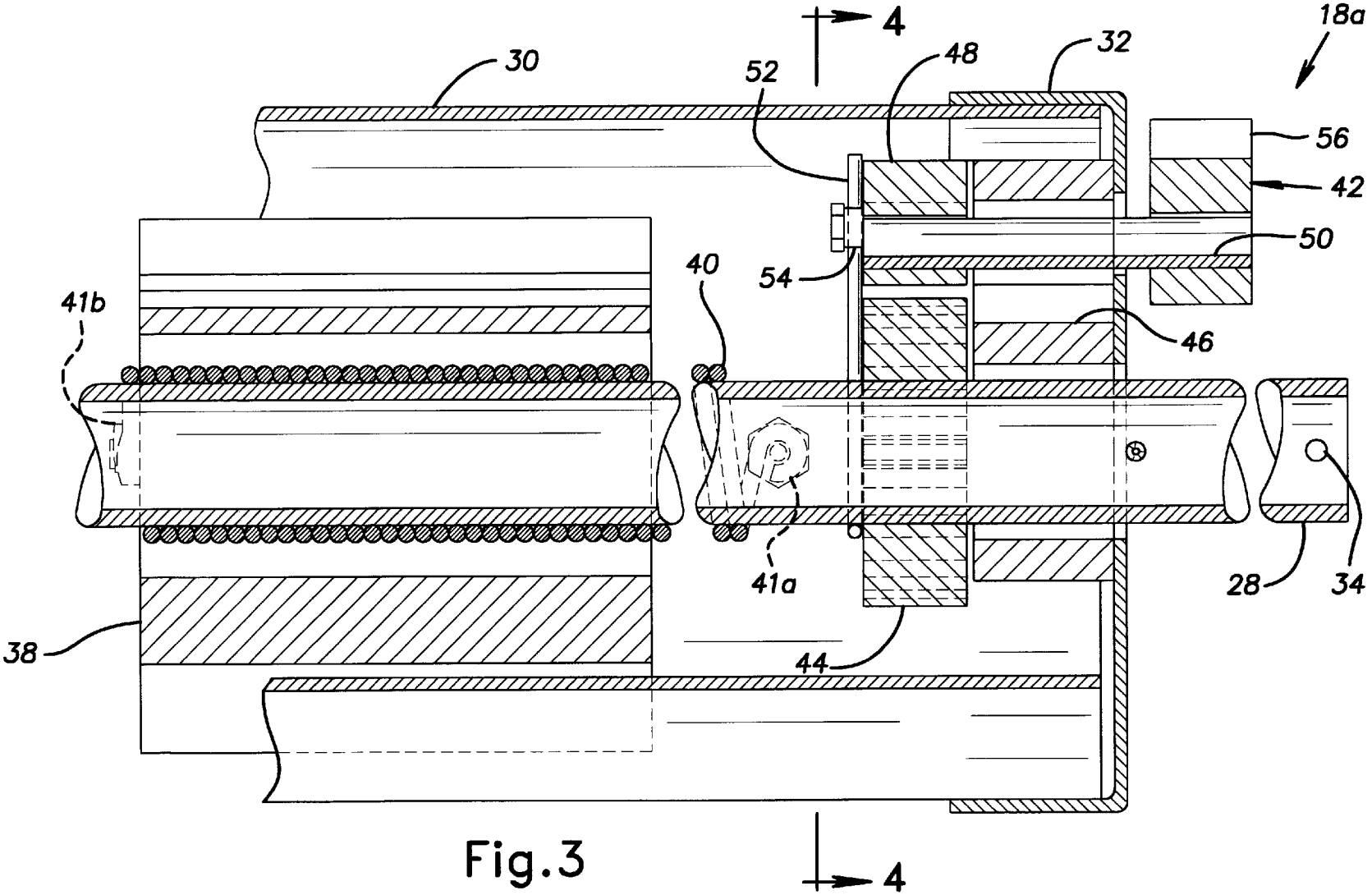
Fig. 3 PRIOR ART
FIG. 3 is a front elevational view, in cross section, of a portion of the roller tube assembly taken along line 3—3 of FIG. 2.
Figure 4:
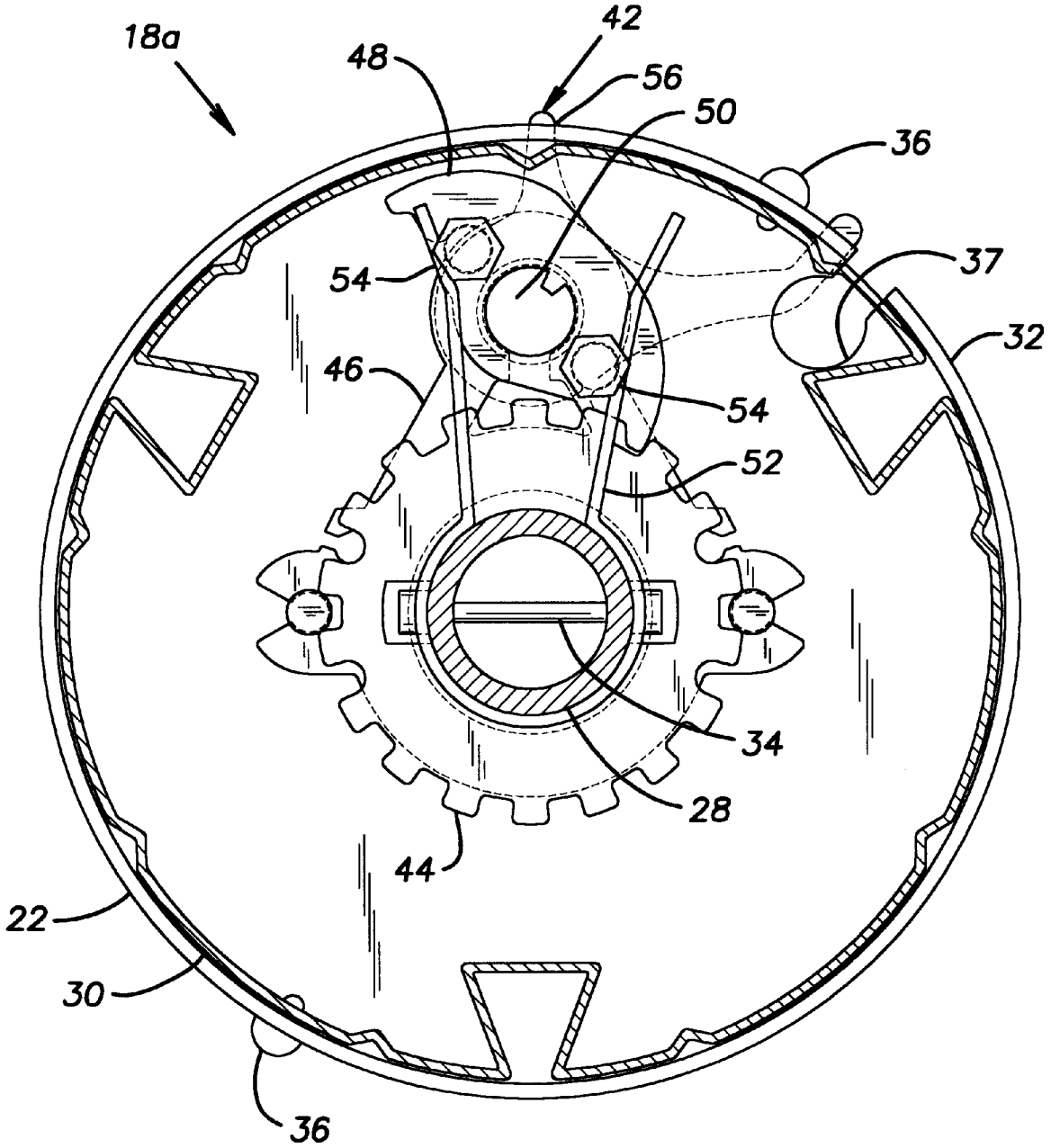
Fig.4 PRIOR ART
FIG. 4 is a elevational view, in cross section, of the roller tube assembly taken along line 4—4 of FIG. 3.

FIGS. 2–4 illustrate a first type of roller tube assembly 18*a* for the retractable awning assembly 12. The illustrated roller tube assembly 18*a* is Model Number 8300 available from the Dometic Corporation, Elkhart, Ind. The roller tube assembly 18*a* includes torsion rods 28, a roller tube 30 rotatably supported by the torsion rod 28, and end caps 32 disposed at the ends of the roller tube 30. The torsion rods 28 extend into the ends of the roller tube 30 and through the end caps 32. The outer ends of the torsion rods 28 have openings provided therein for pins 34 which extend therethrough to pivotably secure the torsion rods 28 to the support arms 22 so that the roller tube assembly 18 is supported by the support arms 22. The end caps 32 generally close the open ends of the roller tube 30 and are secured to the roller tube 30 with fasteners 36, such as the illustrated rivets, to rotate therewith. The end caps 32 also have an opening or notch 37 adjacent an edge which extends from a front face portion to an edge of a flange portion.

Bearings 38 rotatably support the roller tube 30 on the torsion rods 28 and rotate with the roller tube 30 about the torsion rods 28. Mounted in this manner, the torsion rods 28 define a collinear support and rotational axis for the roller tube 30. Coiled torsion springs 40 extend about the torsion rods 28 within the roller tube 30. The outer end of each torsion spring 40 is secured to the torsion rod 28 with a screw 41*a* near the end cap 32 and the inner end of each spring 36 is secured to the idler bearing 38 with a screw 41*b*. When torqued or loaded, the torsion springs 40 bias the awning assembly 12 to the retracted position wherein the awning 20 is wrapped around the roller tube 30.

At least one end of the roller tube assembly 18*a* is provided with a ratchet or lock assembly 42 which selectively limits rotation of the roller tube 30 to one direction or the other. The lock assembly 42 of the illustrated embodiment includes a gear 44, a truss 46, and a lock member 48. The gear 44 has a plurality of teeth defining stops and is secured to the torsion rod 28 for rotation therewith. The truss 46 is rotatable about the torsion rod 28 adjacent the gear 44 and is secured to the end cap 32 for rotation therewith. The lock member 48 is pivotally mounted to the truss 46 by a post 50 extending through a passage in the truss 46 and the end cap 32 and has opposed first and second pawls. Opposed ends of a torsion spring 52 bear against bushings 54 mounted on the lock member 48. The bushings 54 are symmetrically located on opposite sides of the post 46. The spring 52 bears inwardly against the bushings 54 so that one of the pawls engages the gear 44 to resist any tendency of the lock member 48 to remain in the neutral position. The lock member 48 is operably by a handle 56 disposed on an outer end of the post 50 outside the end cap 32.

By operation of the handle 56, the lock member 48 is pivotable between a "roll-up position" and a "roll-down position". In the roll-up position, the first pawl engages a tooth of the gear 44 preventing counter-clockwise rotation (as viewed in FIG. 2) of the roller tube 30 about the torsion rods 28 and allowing clockwise rotation (as viewed in FIG. 2) of the roller tube 30 about the torsion rods 28 so that the awning 20 can be unfurled from the roller tube 30. In the roll-down position, the second pawl engages a tooth of the gear 44 preventing clockwise rotation of the roller tube 30 about the torsion rods 28 and allowing counter-clockwise rotation of the roller tube 30 about the torsion rods 32 so that the awning 20 can be furled onto the roller tube 30.

Figure 5:
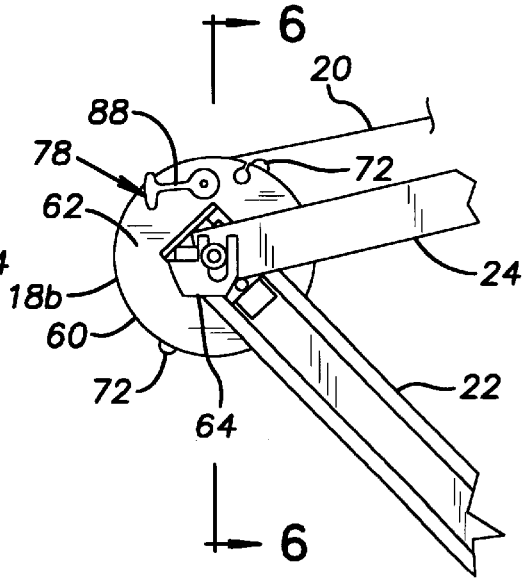
Fig.5 PRIOR ART
FIG. 5 is a right side elevational view of a second roller tube assembly of the retractable awning of FIG. 1.
Figure 6:
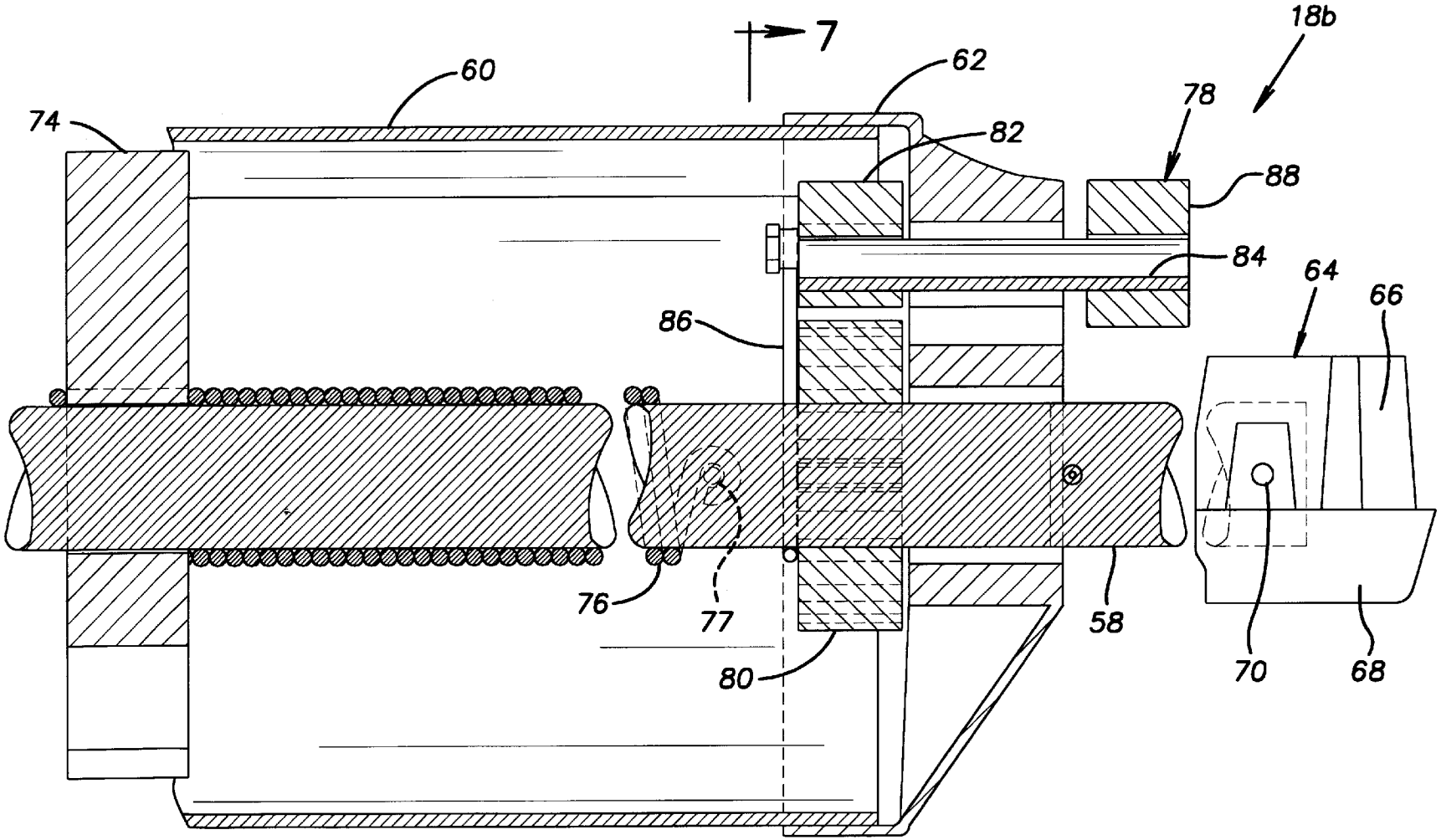
Fig.6 PRIOR ART
FIG. 6 is a front elevational view, in cross section, of a portion of the roller tube assembly taken along line 6—6 of FIG. 5.
Figure 7:
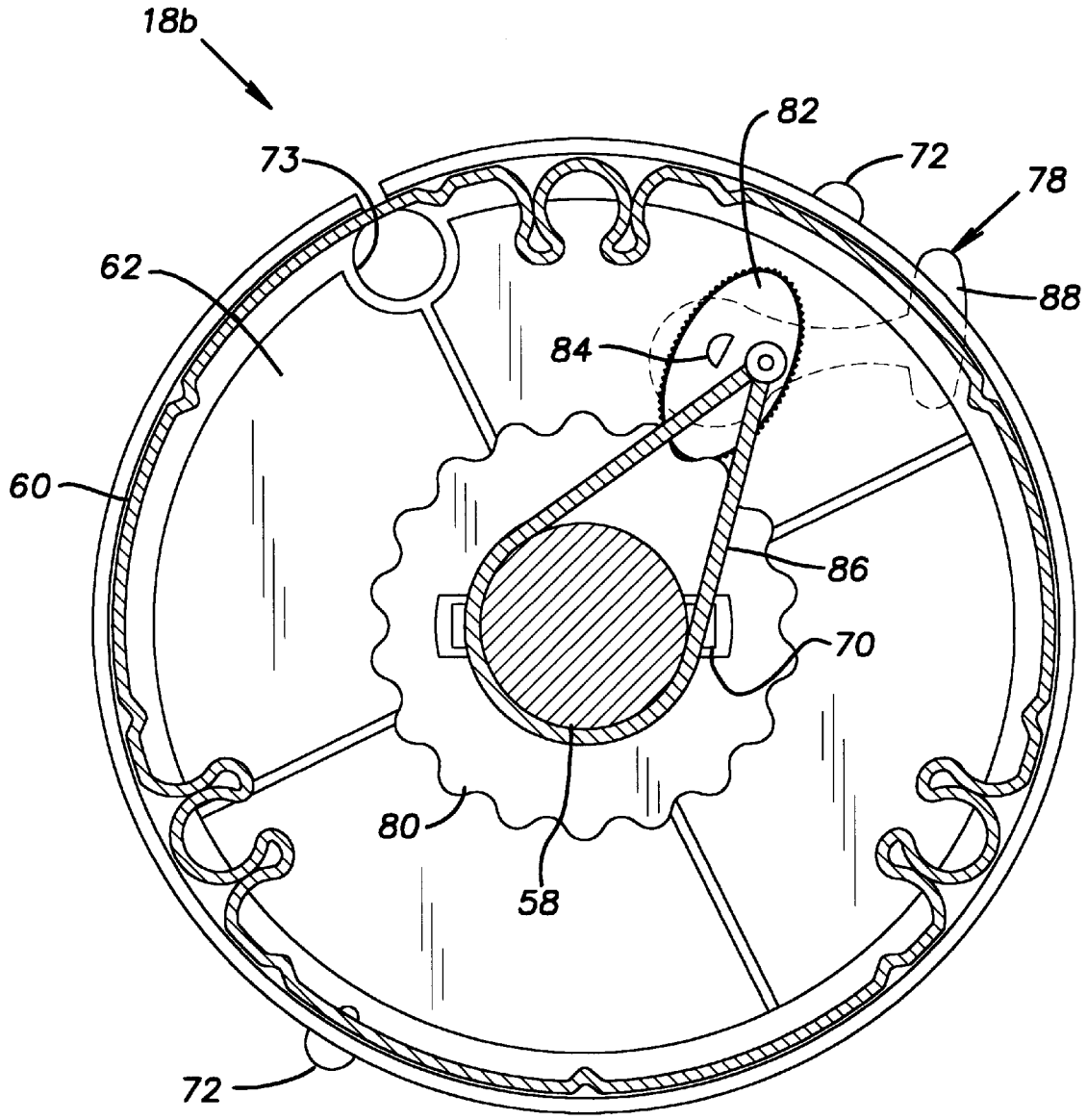
Fig.7 PRIOR ART
FIG. 7 is a elevational view, in cross section, of the roller tube assembly taken along line 7—7 of FIG. 6.

FIGS. 5–7 illustrate a second type of roller tube assembly 18*b* for the retractable awning assembly 12. The illustrated roller tube assembly 18*b* is Model Number 8500 available from the Dometic Corporation, Elkhart, Ind. The roller tube assembly 18*b* includes torsion rods 58, a roller tube 60 rotatably supported by the torsion rod 58, and cast end caps 62 disposed at ends of the roller tube 60. The torsion rods 58 extend into the ends of the roller tube 60 and through the end caps 62. The outer ends of the torsion rods 58 are supported by the support arms 22 and have cast handles 64 attached thereto. Each handle 64 is generally U-shaped in cross section having a pair of spaced-apart walls 66 extending from a base 68. The torsion rod 58 extends partially through the handle 64 between the walls 66 and is rotatably secured thereto with a transversely extending pin 70. Secured in this manner, the handle 64 is rotatable about the pin 70 over a range of about 180 degrees. The end caps 62 generally close the open ends of the roller tube 60 and are secured to the roller tube 60 with fasteners 72, such as the illustrated rivets, to rotate therewith. The end caps 62 also have an opening or notch 73 adjacent an edge which extends from a front face portion to an edge of a flange portion.

Bearings 74 rotatably support the roller tube 60 on the torsion rods 58 and rotate with the roller tube 60 about the torsion rods 58. Mounted in this manner, the torsion rods 58 define a collinear support and rotational axis for the roller tube 60. Coiled torsion springs 76 extend about the torsion rods 58 within the roller tube 60. The outer end of each spring 76 is secured to the torsion rod 58 with a screw 77 near the end cap 62 and the inner end of each spring 76 is secured to the bearing 74. When torqued or loaded, the torsion springs 76 bias the awning assembly 12 to the retracted position with the awning 20 wrapped about on the roller tube 60.

At least one end of the roller tube assembly 18*b* is provided with a ratchet or lock assembly 78 which limits rotation of the roller tube 60 to a single direction. The illustrated lock assembly 78 includes a gear 80 and a lock member 82. The gear 80 has a plurality of lobes defining stops and is secured to the torsion rod 58 for rotation therewith. The lock member 82 is located radially outward of the gear 80 and is pivotably secured to the end cap 62 by a post 84 extending through a passage in the end cap 62. The lock member 82 has opposed first and second pawls. A coil spring 86 extends around the torsion rod 58 and has ends secured to the lock member 82 between the pawls and offset from the post 84. The spring 86 pivots the lock member 82 about the post 84 so that one of the pawls engages the gear 80 to resist any tendency of the lock member 82 to remain in the neutral position. The lock member 82 is operable by a handle 88 disposed on an end of the post 84 outside the end cap 62.

By operation of the handle 88, the lock member 76 is movable between a "roll-up position" and a "roll-down position". In the roll-up position, the first pawl engages a lobe of the gear 80 preventing counter-clockwise rotation (as viewed in FIG. 5) of the roller tube 60 about the torsion rods 58 and allowing clockwise rotation (as viewed in FIG. 2) of the roller tube 60 about the torsion rods 58 so that the awning 20 can be unfurled from the roller tube 60. In the roll-down position, the second pawl engages a tooth of the gear 80 preventing clockwise rotation of the roller tube 60 about the torsion rods 58 and allowing counter-clockwise rotation of the roller tube 60 about the torsion rods 58 so that the awning 20 can be furled onto the roller tube 60.

When the awning assembly 12 is to be moved from the stowed position to the retracted position, the lock assembly 42, 78 is moved to the roll down-position and the pull strap is pulled to move the roller tube assembly 18 away from the vehicle. The roller tube 30, 60 rotates to unfurl the awning 20. To retract the awning assembly 12 back to the stowed position, the lock assembly 42, 78 is moved to the roll-up position by operation of the handle 56, 88, and the bias of the torsion springs 40, 76 rotates the roller tube 30, 60 to furl the awning 20 onto the roller tube 30, 60 and move the awning assembly 12 to the vehicle side wall 14.

The foregoing describes known roller tube assemblies 18 and is provided herein to clarify the environment in which the present invention, to be described hereinafter, is to be employed. It is noted that the present invention is in no way limited to the roller tube assemblies 18*a*, 18*b* described hereinbefore. The roller tube assemblies 18*a*, 18*b* described in detail are merely representative of many types of roller tube assemblies which can be utilized with the present invention.

Figure 8:
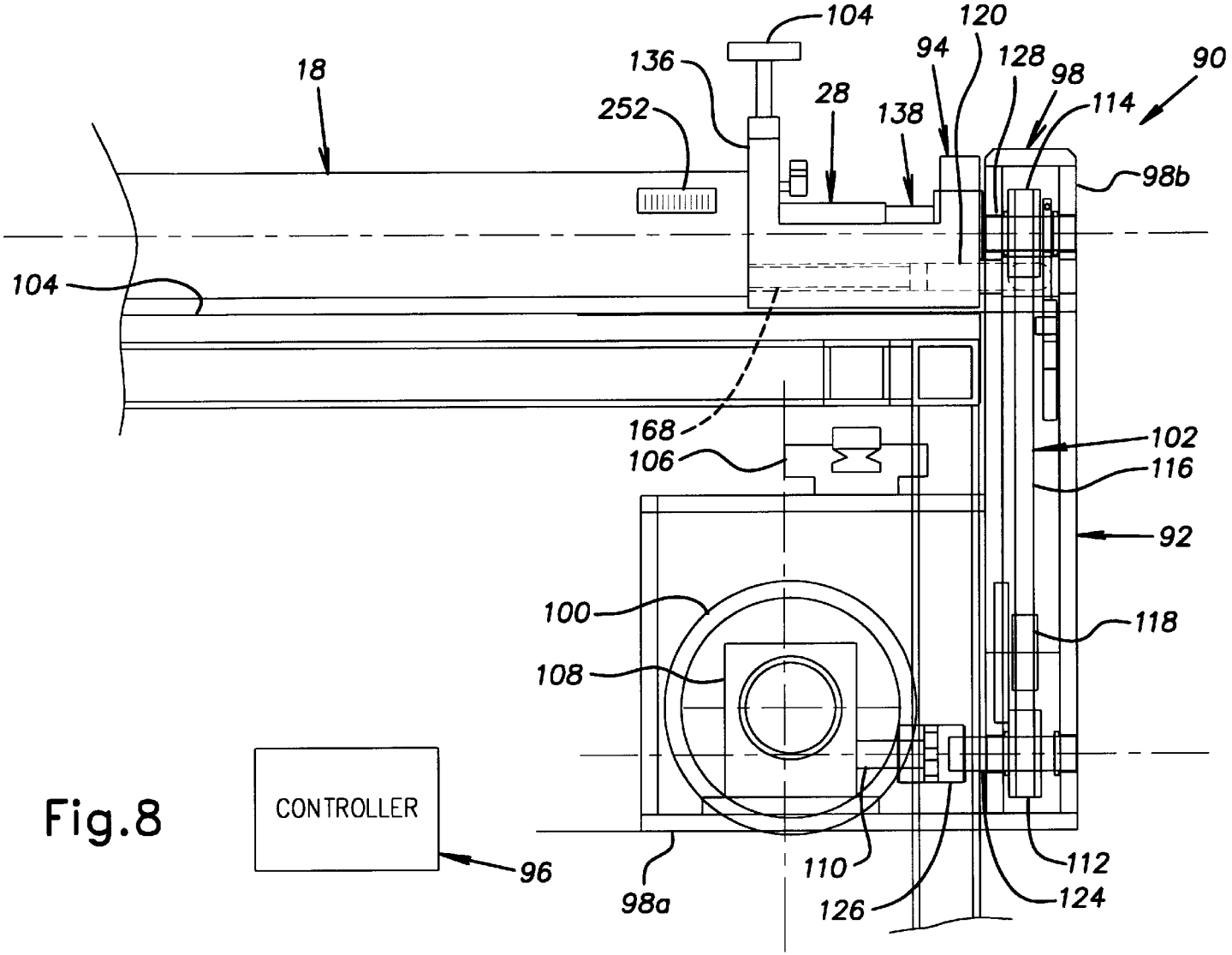
FIG. 8 is a is an elevational view of the roller tube assembly of FIG. 1 secured to a torsion winder according to the present invention.
Figure 10:
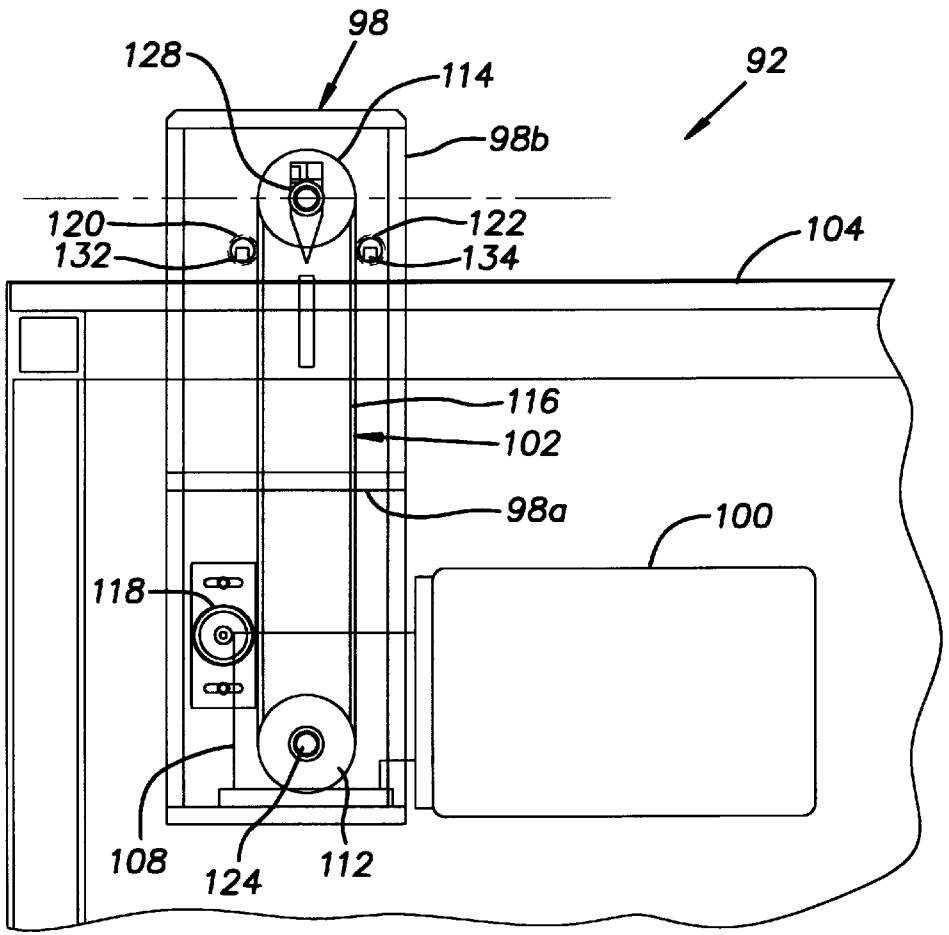
FIG. 10 is an end elevational view of the drive assembly of the torsion winder of FIG. 8.

FIG. 8 illustrates a torsion winder or winding mechanism 90 for torquing or loading torsion springs 40, 76 according to the present invention. The winding mechanism 90 has the roller tube assembly 18 secured to for a winding operation. The winding mechanism 90 includes a drive assembly 92, a holding assembly 94, and a control system 96.

Figure 9:
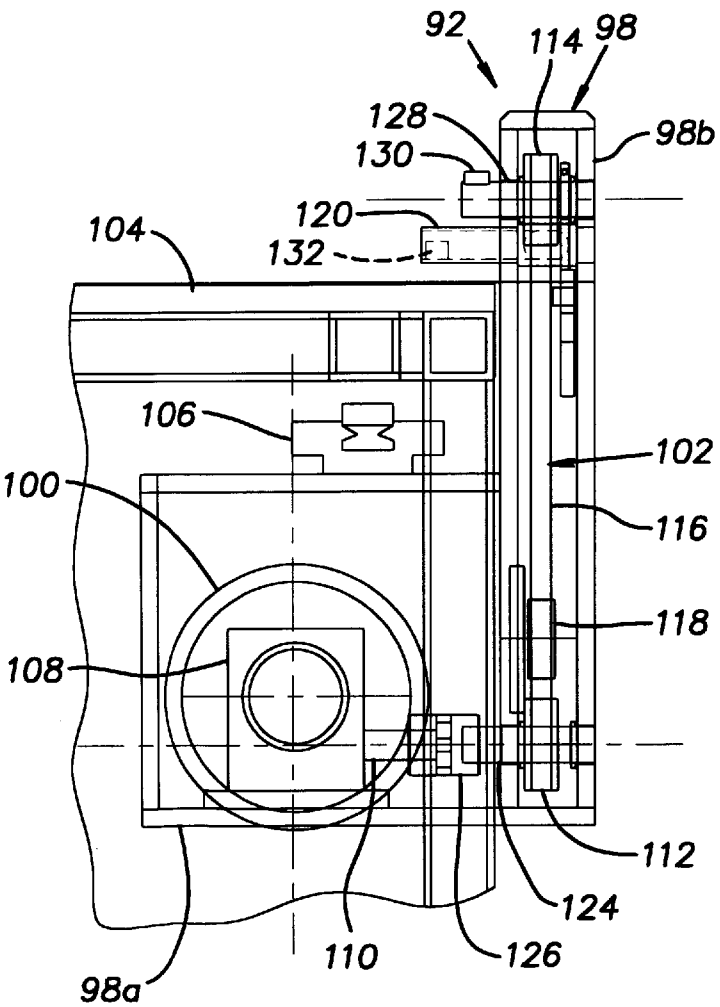
FIG. 9 is a side elevational view of a drive assembly of the torsion winder of FIG. 8.

As best shown in FIGS. 8 and 9, the drive assembly 92 includes a support frame 98, a drive motor 100, and a belt assembly 102. The support frame 98 is sized and shaped to cooperate with a table 104 and has a first portion 98*a* which is located below the top of the table 104 and a second portion 98*b* vertically extending along the side of the table 104 from the first portion 98*a* to a location above the top of the table 104. Preferably, the support frame 98 includes a linear bearing 106 so that the frame can 98 be laterally moved along the side of the table 104.

The drive motor 100 is transversely mounted on the frame first portion 98*a* and is located below the top of the table 104. The drive motor 100 is preferably a 3-phase electric motor. The drive motor 100 is provided with a gear reduction drive 108 having a longitudinally and forwardly extending drive shaft 110 adjacent the frame second portion 98*b*. The drive motor 100 and the gear reduction drive 108 are preferably capable of operating at rotational speeds up to about 3400 RPM. A suitable motor and gear reduction drive are available from Allen Bradley/Rockwell Automation, Milwaukee, Wis.

The belt assembly 102 includes a first or input pulley 112, a second or output pulley 114, a drive belt 116, an idler pulley 118, and first and second alignment pins or tubes 120, 122. The input pulley 112 is rotatably mounted at the lower end of the frame second portion 98*b*. The input pulley 112 is supported by an input shaft 124 held within suitable bushings. The input shaft 124 rearwardly extends to the frame first portion 98*a*. The rotational axis of the input shaft 124 is substantially collinear with the rotational axis of the drive shaft 110. The input shaft 112 is connected to the drive shaft 110 with a suitable drive coupling 126 for rotation therewith.

The output pulley 114 is rotatably mounted at the upper end of the frame second portion 98*b*. The output pulley 114 is supported by an output shaft 128 held in suitable bushings. The rotational axis of the output shaft 128 is substantially parallel with and spaced apart from the rotational axis of the input shaft 124. The output shaft 128 rearwardly extends over the top of the table 104 and the frame first portion 98*a*. A longitudinally extending key 130 is provided on the output shaft 128 to cooperate with the holding assembly 94 as describe in more detail hereafter.

The belt 116 extends around each of the pulleys 112, 114 so that the output shaft 128 is rotated when the input shaft 124 is rotated by the drive shaft 110. The idler pulley 118 is adjustably mounted to the frame second portion 98*b* adjacent the belt 116 and near the input pulley 112. The idler pulley 116 is laterally movable toward and away from the belt 116 so that an appropriate amount of pressure is applied by the belt 116 against the input pulley 112.

The alignment tubes 120, 122 are secured to the upper end of the frame second portion 98*b* below the output shaft 128 and above the top of the table 104. The alignment tubes 120, 122 rearwardly extend from the frame second portion 98*b* and are each substantially parallel to the output shaft 128. The alignment tubes 120, 122 are spaced apart on opposite sides of the output shaft 128. Proximity sensors 132, 134 are located at the rear end of the alignment tubes 120, 122 and are utilized to identify the holding assembly 94 as described in more detail hereinafter.

Figure 11A:
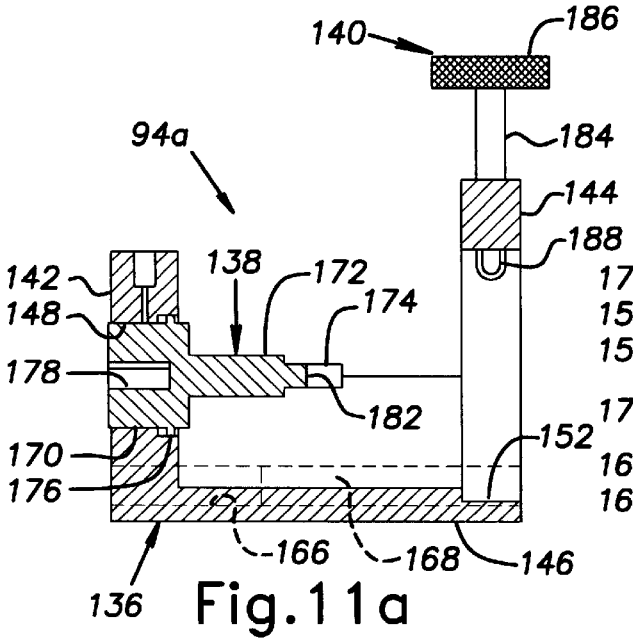
FIGS. 11*a* and 11*b* are side and end elevational views, partially in cross section, of a first holding assembly of the torsion winder of FIG. 8.
Figure 11B:
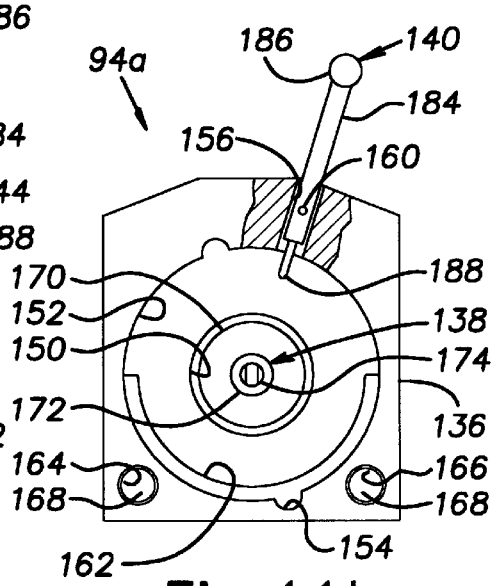

FIGS. 11*a* and 11*b* illustrate a first holding assembly 94*a* which is adapted to secure either end of the roller tube assembly 18*a* of FIGS. 2–4. The first holding fixture 94*a* includes a support 136, a coupler 138 for rotatably joining the output shaft 128 with the torsion rod 28 of the roller tube assembly 18, and a lock 140 for securing the roller tube 30 of the roller tube assembly 18*a* against rotation.

Figure 12A:
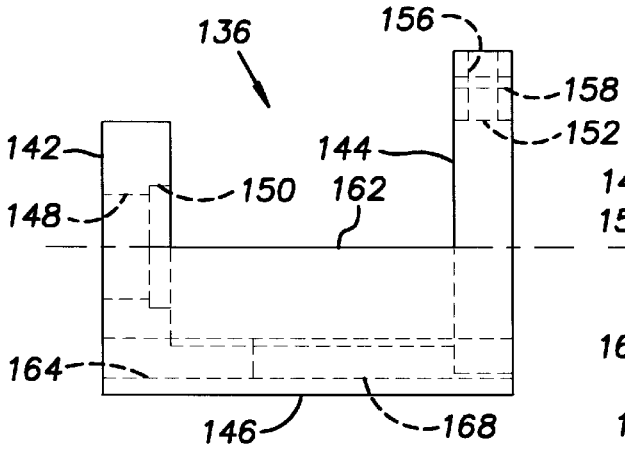
FIGS. 12*a* and 12*b* are side and end elevational views, respectively, of a support of the holding assembly of FIGS. 11*a* and 11*b;*
Figure 12B:
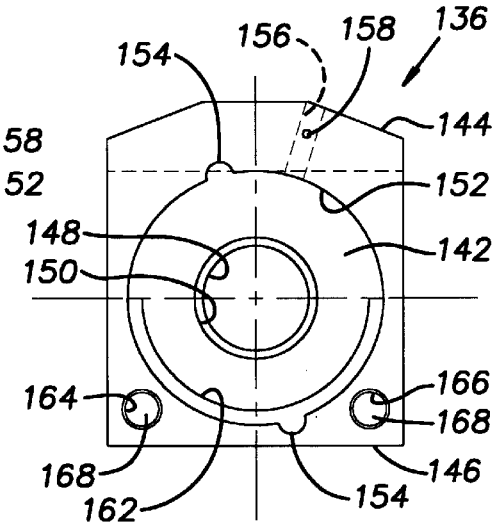

As best shown in FIGS. 12*a* and 12*b*, the support 136 has forward and rear walls 142, 144 upwardly extending from opposite ends of a base wall 146. The forward wall 142 has an opening 148 formed therein with a counterbore 150 at an inner or forward side thereof. The opening 148 and counterbore 150 are sized to cooperate with the coupler 138 as described in more detail hereafter. The rear wall 144 has an opening 152 formed therein which is sized and shaped to receive the end cap 32 of the roller tube assembly 18. The opening 152 is provided with an opposed pair of arcuate notches 154 which are sized and shaped to receive the fasteners 36 attaching the end cap 32 to the roller tube 30. A radially extending hole 156 is provided in the rear wall 144 which extends from the top surface of the rear wall 144 to the opening 152 in the rear wall 144. The hole 156 is positioned so that it is aligned with the notch 37 in the end cap 32 when the end cap 32 is within the opening 152. The hole 156 is sized and shaped to cooperate with the lock 140 as described in more detail hereinafter. A second hole 158 is formed generally perpendicular to the first hole 156 and has a smaller diameter than the first hole 156. The second hole 158 is sized to have a dowel pin 160 (FIG. 11*b*) pressed therein. The base wall 146 has a generally arcuate shaped upper surface 162 between the forward and rear walls 142, 144. The base wall 146 also has a pair of parallel and spaced apart bores 164, 166 which are sized and shaped to closely cooperate with the first and second alignment tubes 120, 122 of the drive assembly 92. A plug 168 is provided in the rear end of each of the bores 164, 166. The plugs are sized to cooperate with the proximity sensors 132, 134 when the holding assembly 94*a* is secured to the drive assembly 92 as described in more detail hereinafter.

Figure 13A:
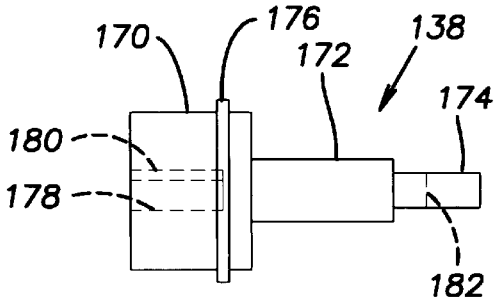
FIGS. 13*a* and 13*b* are side and end elevational views, respectively, of a coupler of the holding assembly of FIGS. 11*a* and 11*b;*
Figure 13B:
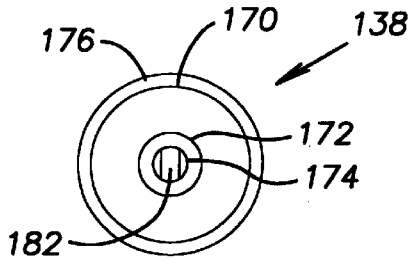

As best shown in FIGS. 13*a* and 13*b*, the coupler 138 has generally cylindrically-shaped front, center and rear portions 170, 172, 174. The front portion 170 is sized and shaped to cooperate with the opening 148 in the forward wall 142 of the support 136. The front portion 170 has a flange 176 which is sized to cooperate with the counterbore 150 in the forward wall 142 of the support 136. The front portion 170 also has a blind hole 178 with a key way 180 which is sized and shaped to receive the key 130 of the output shaft 128 to rotationally interlock the coupler 138 to the output shaft 128 for rotation therewith. The center portion 172 has a diameter generally smaller than the front portion 170 to form an abutment therebetween. The rear portion 174 has a diameter generally smaller than the center portion 172 to form an abutment therebetween. The rear portion 174 is sized and shaped to extend into the torsion rod 28 of the roller tube assembly 18*a*. A notch 182 is formed in the rear portion 174 so that the rear portion 174 is generally "fork-shaped". The notch 182 is sized and shaped to receive the pin 34 of the roller tube assembly 18*a* therein to rotationally secure the coupler 138 to the torsion rod 28.

Figure 14A:
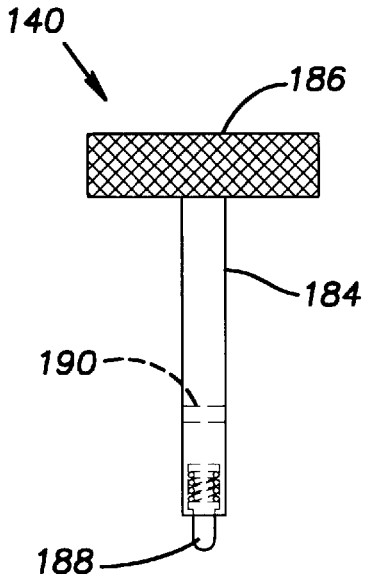
FIGS. 14*a* and 14*b* are side and end elevational views, respectively, of a lock of the holding assembly of FIGS. 11*a* and 11*b;*
Figure 14B:
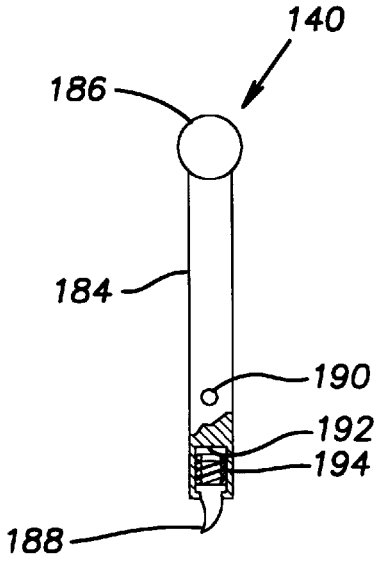

As best shown in FIGS. 14*a* and 14*b*, the lock 140 includes a main body 184, a handle 186 at the top end of the main body 184, and a tooth or tab 188 at the bottom end of the main body 184. The main body 184 is generally elongate and cylindrically shaped. The main body 184 is sized to loosely fit within the first hole 156 of the support 136. A clearance hole 190 is laterally formed through the main body 184 for receiving the pin 160 therethrough. The handle 186 is generally cylindrical and substantially perpendicular to the main body 184. The handle 186 is preferably provided with a gripping surface such as, for example, by a knurled surface. The tab 188 is retained within an opening 192 at the lower end of the main body 184. A spring member 194 is provided to bias the tab 188 to a fully extended position. The tab 188 is generally arcuate or convex curved on each side except one side which is concave curved and is sized and shaped to cooperate with the notch 34 in the end cap 32 of the roller tube assembly 18 during torquing of the torsion spring 40.

As best shown in FIG. 11*b*, the lock 140 is held within the first hole 156 of the support 136 by the dowel pin 160 and is pivotable about the dowel pin 160. The lock 140 is preferably pivotable over a range of about 15 degrees. The flat or locking engagement side of the tab 188 is positioned to engage the notch 37 of the end cap 32 when the torsion rod is rotated (clockwise as viewed in FIG. 11*b*) to prevent rotation of the end cap 32 and the roller tube 30.

To secure the roller tube assembly 18 within the holding assembly 94*a*, the pin 34 is installed at the end of the torsion rod 28, if not already installed. The end of the roller tube assembly 18 is then horizontally moved across the top of the table 104 and through the opening 152 in the rear wall 144 of the support 136 until the end cap 32 is within the opening 152. The end cap fasteners 36 must be aligned with the notches 154 for the end cap 32 to enter the opening 152. Proper orientation of the fasteners 36 also aligns the end cap notch 37 with the lock tab 188. Note that the spring loaded lock tab 188 is depressed by the end cap 32 as it is inserted and then resiliently snaps or extends into the notch 37.

Figure 15:
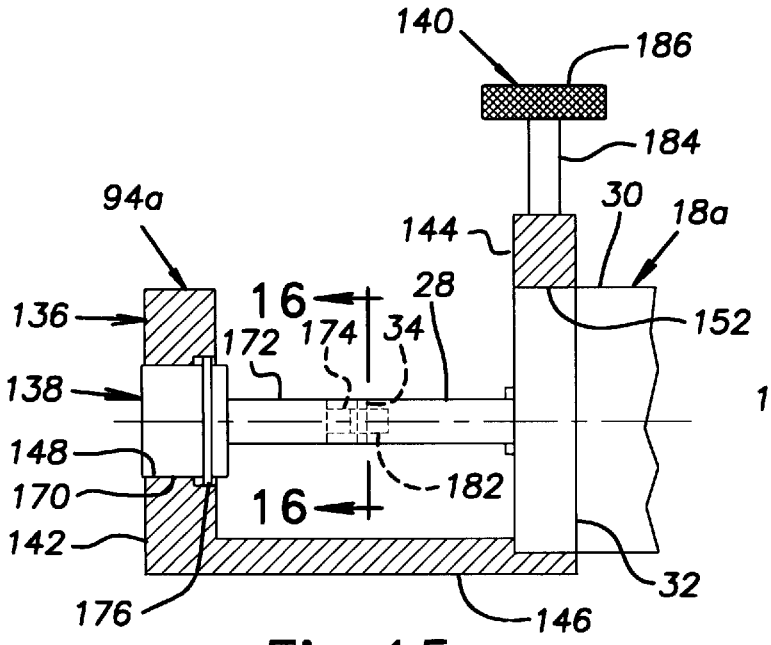
FIG. 15 is a side elevational view, in partial cross section, of the holding fixture of FIGS. 11*a* and 11*b* with the roller tube assembly of FIGS. 2–4 secured thereto.
Figure 16:
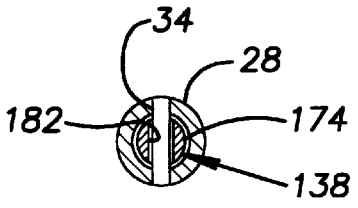
FIG. 16 is a cross sectional view taken along line 16—16 of FIG. 15.

As best shown in FIGS. 15 and 16, when the end cap 32 is fully within the opening 152, the torsion rod pin 34 is within the coupler notch 182 and the lock tab 188 is within the end cap notch 37. Secured in this manner, the torsion rod 28 is interconnected with the coupler 138 for rotation therewith and the roller tube 30 is interconnected with the lock 140 for preventing rotation of the roller tube 30. From the above description, it can be seen that the roller tube assembly 18 is easily installed into and removed from the holding assembly 94*a* with a simple horizontal sliding movement.

Figure 17A:
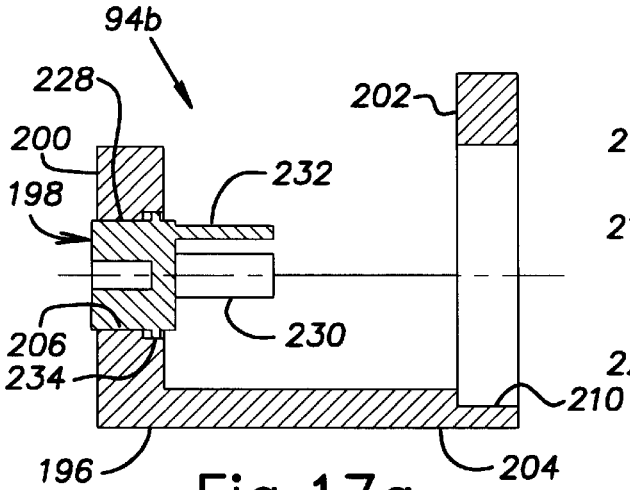
FIGS. 17*a* and 17*b* are side and end elevational views, respectively, of a second holding assembly of the torsion winder of FIG. 8.
Figure 17B:
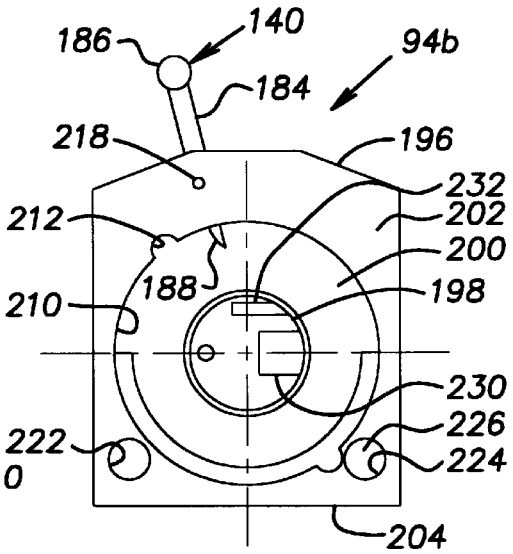

FIGS. 17*a* and 17*b* illustrate a second holding assembly 94*b* which is adapted to secure the right-hand end of the roller tube assembly 18*b* of FIGS. 5–7. The holding fixture 94*b* includes a support 196, a coupler 198 for rotatably joining the output shaft 128 with the torsion rod 58 of the roller tube assembly 18*b*, and a lock 140 for securing the roller tube 60 of the roller tube assembly 18*b* against rotation. The lock 140 is the same as described above for the first holding assembly 94*a*.

Figure 18A:
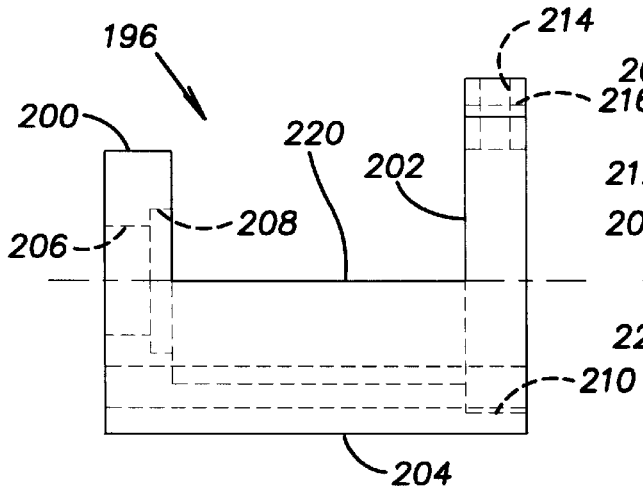
FIGS. 18*a* and 18*b* are side and end elevational views, respectively, of a support of the holding assembly of FIGS. 17*a* and 17*b;*
Figure 18B:
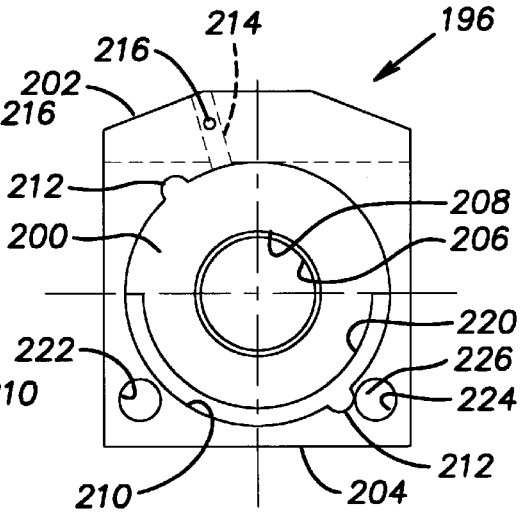

As best shown in FIGS. 18*a* and 18*b*, the support 196 has forward and rear walls 200, 202 upwardly extending from opposite ends of a base wall 204. The forward wall 200 has an opening 206 formed therein with a counter bore 208 at an inner or forward side thereof. The opening 206 and the counterbore 208 are sized to cooperate with the coupler 198 as described in more detail hereinafter. The rear wall 202 has an opening 210 formed therein which is sized and shaped to receive the end cap 62 of the roller tube assembly 18*b*. The opening 210 is provided with an opposed pair of arcuate notches 212 which are sized and shaped to receive the fasteners 72 attaching the end cap 62 to the roller tube assembly 18*b*. A radially extending hole 214 is provided in the rear wall 202 which extends from the top surface of the rear wall 202 to the opening 210 in the rear wall 202. The hole 216 is positioned so that it is aligned with the notch 73 in the end cap 62 when the end cap 62 is within the opening 210. The hole 216 is sized and shaped to cooperate with the lock 140 as described hereinbefore. A second hole 216 is formed generally perpendicular to the first hole 214 and has a smaller diameter than the first hole 214. The second hole 126 is sized to have a dowel pin 218 (FIG. 17*b*) pressed therein. The base wall 204 has a generally arcuate shaped upper surface 220 between the forward and rear walls 200, 202. The base wall 204 also has a pair of parallel and spaced apart bores 222, 224 which are sized and shaped to closely cooperate with the alignment tubes 120, 122 of the drive assembly 92. A plug 226 is provided in the rear end of the second bore 224 (the right-hand bore as viewed in FIG. 17*b*). The plug 226 is sized to cooperate with the first proximity switch 132 when the holding assembly 94*b* is secured to the drive assembly 92 as described in more detail hereinafter.

Figure 19A:
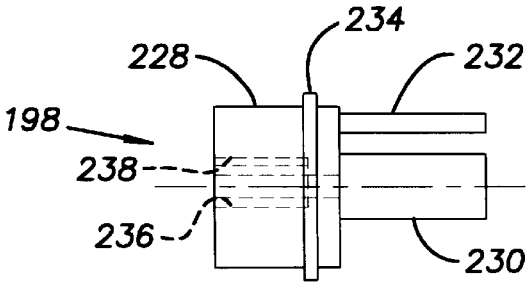
FIGS. 19*a* and 19*b* are side and end elevational views, respectively, of a coupler of the holding assembly of FIGS. 17*a* and 17*b;*
Figure 19B:
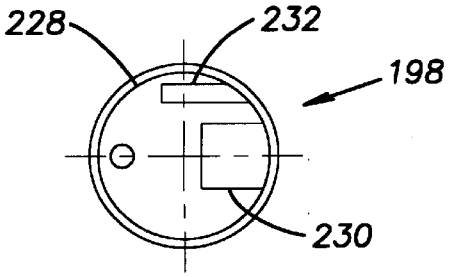

As best shown in FIGS. 19*a* and 19*b*, the coupler 198 has a generally cylindrically-shaped main body 228 and first and second arms 230, 232 rearwardly extending from the main body 228. The main body 228 is sized and shaped to cooperate with the opening 206 in the forward wall 200 of the support 196. The main body 228 has a flange 234 which is sized to cooperate with the counterbore 208 in the forward wall 200 of the support 196. The main body 228 also has a blind hole 236 with a key way 238 which is sized and shaped to receive the key 130 of the output shaft 128 to rotationally interlock the coupler 198 to the output shaft 128 for rotation therewith. The arms 230, 232 are generally elongate and rectangular in cross section. The arms 230, 232 are sized and shaped to rotationally interlock with the torsion rod 58 of the roller tube assembly 18 for rotation therewith.

Figure 20:
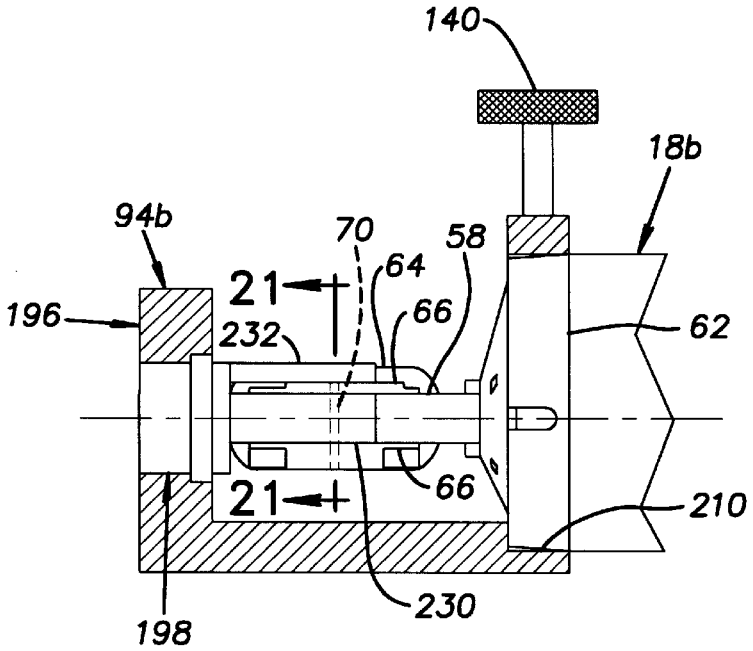
FIG. 20 is a side elevational view, in partial cross section, of the holding fixture of FIGS. 17*a* and 17*b* with the roller tube assembly of FIGS. 5–7 secured thereto.
Figure 21:
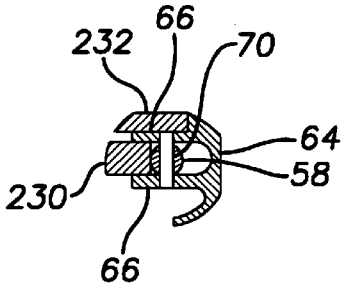
FIG. 21 is a cross sectional view taken along line 21—21 of FIG. 20.

As best shown in FIGS. 20 and 21, the arms 230, 232 are spaced apart so that the first arm 230 extends between the walls 66 of the handle 64 and the second wall 232 extends laterally outside one of the walls 66 of the handle 64 to rotationally secure the coupler 198 to the torsion rod 58.

To secure the roller tube assembly 18*b* within the second holding assembly 94*b*, the end of the roller tube assembly 18 is horizontally moved across the top of the table 104 and through the opening 210 in the rear wall 202 of the support 196 until the end cap 62 is within the opening 210. The end cap fasteners 78 must be aligned with the notches 212 for the end cap 62 to enter the opening 210. Proper orientation of the fasteners 78 also aligns the end cap notch 73 with the lock tab 188. When the end cap 62 is fully within the opening 210, the torsion rod handle 64 is rotationally interlocked with the coupler arms 230, 232 and the lock tab 188 is within the end cap notch 73. Secured in this manner, the torsion rod 58 is interconnected with the coupler 198 for rotation therewith and the roller tube 60 is interconnected with the lock tab 188 for preventing rotation of the roller tube 60. From the above description it can be seen that the roller tube assembly 18*b* is easily installed into and removed from the holding assembly 94*b* with a simple horizontal movement.

Figure 22A:
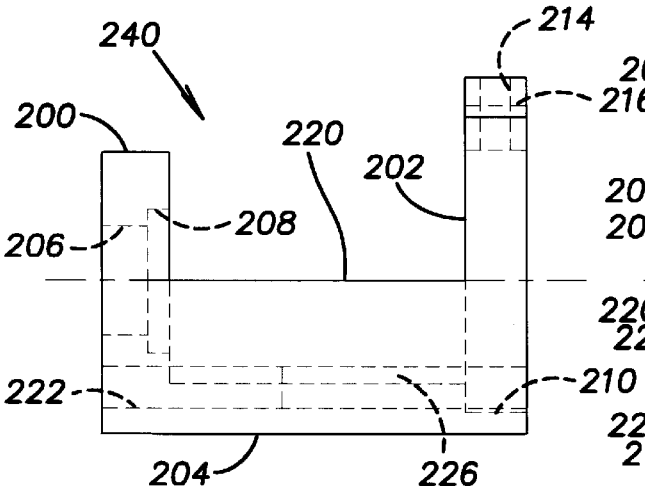
FIGS. 22*a* and 22*b* are side and end elevational views, respectively, of a support similar to the support of FIGS. 18*a* and 18*b* for a third holding assembly.
Figure 22B:
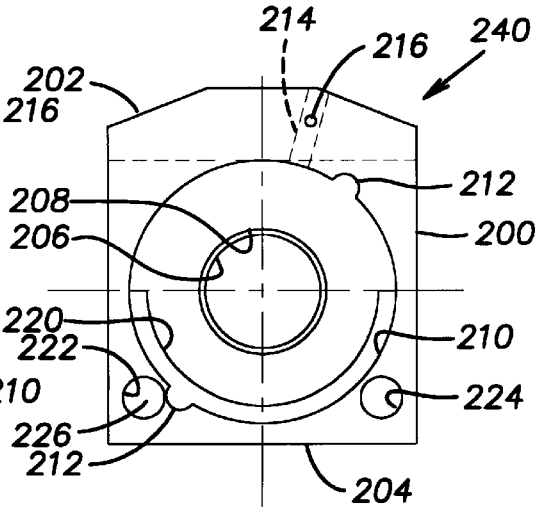

FIGS. 22*a* and 22*b* illustrate a support 240 for a third holding assembly which is adapted to secure the left-hand end of the roller tube assembly 18 of FIGS. 5–7. The third holding assembly includes the coupler 198 and lock 140 as described above for the second holding assembly 94*b*. Additionally, the roller tube assembly 18*b* is secured within the third holding assembly the same as described above for the second holding fixture 94*b*.

The support 240 is the same as the support 196 for the second holding fixture 94*b* described above except for the placement of the notches 212 and the hole 214 and the location of the plug 226. Therefore, like reference numbers are used for the like structure. The support 240 illustrates that the features of the opening 210 must conform to the specific end cap 62 that is to be utilized. Accordingly, different roller tube assemblies or different ends of a single roller tube assembly may require a different support. The support 240 also illustrates that the plug 226 can be located in a different location to identify a different type of holding assembly 94.

Figure 23:
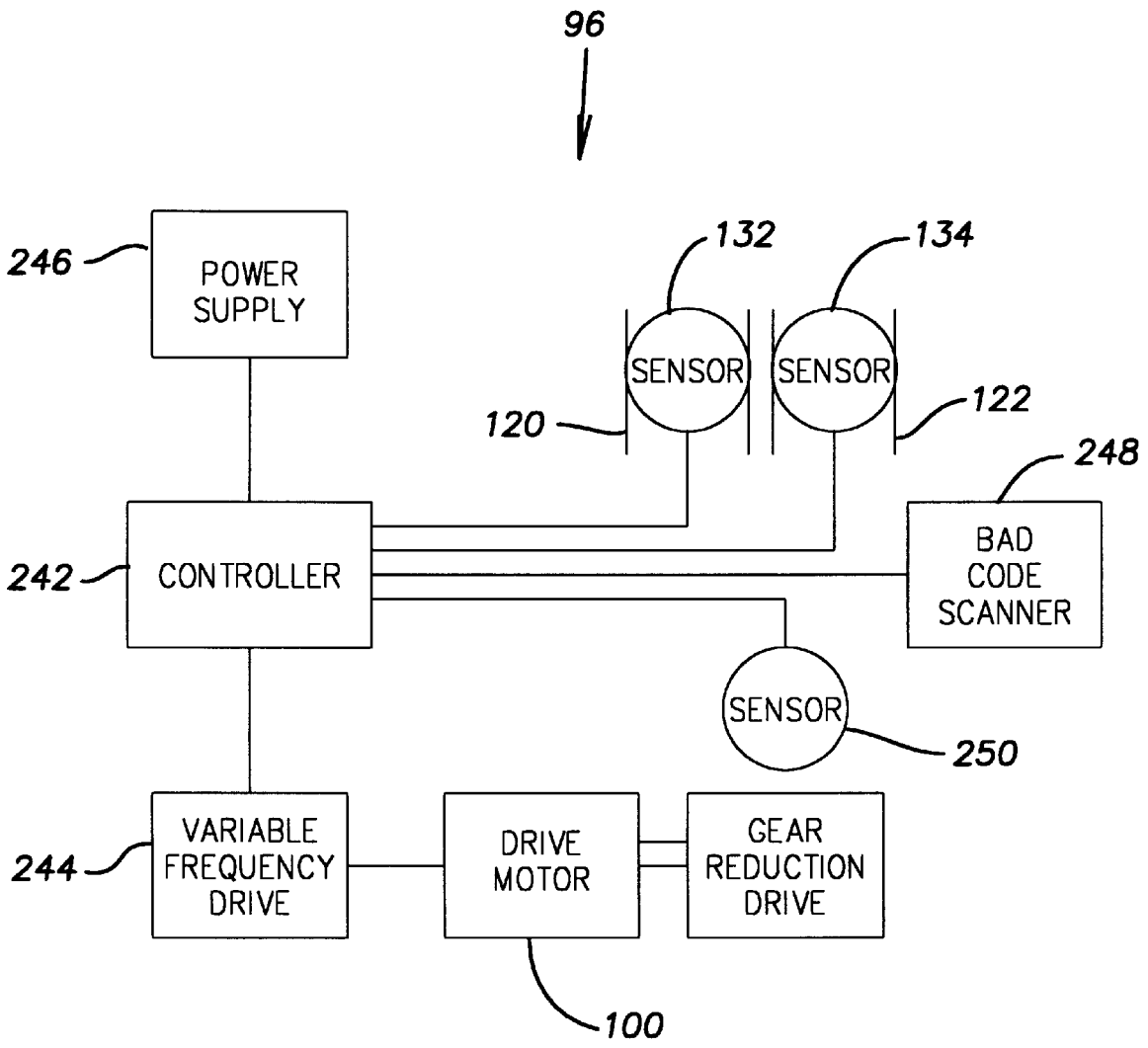
FIG. 23 is a diagrammatic view of a control system of the torsion winder of FIG. 8.

FIG. 23 diagrammatically illustrates the control system 96 for the torsion winder 90. The control system 96 includes a controller 242, a variable frequency drive 244, a power supply 246, a bar code scanner 248, a positional proximity sensor 250, and the tool identification proximity sensors 132, 134. The controller 242 provides operator interface, bar code interface, tooling identification, data storage, position identification, and overall control. The variable frequency drive 244 provides acceleration, deceleration, and locked position control of the drive motor. A suitable controller 242 and drive 244 are available from Allen Bradley/Rockwell Automation, Milwaukee, Wis.

The controller 242 is connected to the bar code scanner 248 to provide roller tube assembly identification. Each roller tube assembly 18 is preferably provided with an identification tag 252 (FIG. 8) having a bar code marked thereon. The bar code preferably indicates the model number of the roller tube assembly 18 and the proper number of turns or revolutions (turn count) required to obtain a desired load or torque on the torsion spring 40, 78. When the tag 252 is scanned by the bar code scanner 248, the controller 242 identifies the model number and the turn count of the roller tube assembly 18 to which the tag 252 is affixed. The proper turn count is typically up to about 13 revolutions or turns. The controller 242 is preprogrammed with limits or boundaries for the data so that the procedure can be stopped if the input data is clearly inaccurate.

The controller 242 also is connected to the proximity switches 132, 134 located in the alignment tubes 120, 122 to provide tooling identification. Having two proximity sensors 123, 134 enables three different holding assemblies 94 to be identified. When neither proximity sensor 132, 134 indicates that a plug 168, 226 is present, the controller 242 identifies that no holding assembly 94 is installed. When both proximity sensors 132, 134 indicate a plug 168, 226 is present, the controller identifies that a first type of holding assembly 94*a* is installed. When only the first proximity sensor 132 indicates a plug 168, 226 is present, the controller 242 identifies that a second type of holding assembly 94*b* is installed. When only the second proximity sensor 134 indicates a plug 168, 226 is present, the controller 242 identifies that a third type of holding assembly 94*c* is installed. It is noted that a greater or smaller number of proximity sensors 132, 134 could be utilized to identify a different number of holding assemblies 94.

Once the controller 242 identifies the model number of the roller tube assembly 18, the controller 242 compares the holding assembly 94 identified as being installed, if any, with the proper holding fixture 94 for the roller tube assembly 18 identified. A data base of the proper holding fixture 94 for various model numbers is stored in the controller 242. If the wrong holding assembly 94 or no holding assembly 94 is installed, the controller 242 warns the operator and identifies the proper holding assembly 94. The controller 242 will not let the winding operation proceed until the proper holding assembly 94 is installed. The controller 242 also indicates to the operator when the proper holding assembly 94 is installed.

The controller 242 is also connected to the variable frequency drive 244 and the positional proximity sensor 250 located at the gear reduction drive 108 to provide positional control. When the operator initiates a winding operation, the controller 242 starts the drive motor 100 from a home position and accelerates it to a rotational speed of up to about 3400 RPM. The controller 242 counts the number of revolutions as the drive motor 100 turns. Completed turns are identified by the proximity sensor 250. When the last revolution of the proper number of turns is approached, the controller 242 slows down the speed of the drive motor 100 so that the drive motor 100 is able to stop at the home position. The controller 242 stops the drive motor 100 at the home position when the proper number of turns has been completed. The drive motor 100 electronically brakes the assembly so that it is locked in the home position to prevent the torsion spring from unwinding. The controller 242 is able to identify the home position with the proximity sensor 250. Therefore, the drive motor 100 starts and stops at the same position, the home position. When the operator indicates that the roller tube assembly 18 is manually locked, the controller 242 rotates the drive motor 100 in the opposite direction for a small distance adequate to take away built-up tension. Typically, the drive motor 100 is backed-up about 1 mm.

The controller 242 preferably has a memory which allows a winding operation to be stopped midway for a period of time, such as a meal break or over night, and resumed. The controller also preferably prompts the operator as to the next operation step to be taken. These features allow a winding operation to be interrupted and continued with a low risk of error.

A winding operation begins by positioning a roller tube assembly 18 on the top of the table 104 and scanning the identification tag 252 with the bar code scanner 248. The controller 242 identifies the model number and the proper number of turns from the bar code and selects the proper holding fixture 94 from the prestored data. The controller then identifies if the proper holding fixture 94 is installed. If the wrong holding fixture 94 is installed or if no holding fixture 94 is installed, the controller 242 indicates such to the operator and also indicates the proper holding fixture 94 which should be installed. The operator installs the proper holding assembly 94 by fully inserting the alignment tubes 120, 122 of the drive assembly 92 into the holding assembly 94 and verifying that the output shaft 128 is rotatably interlocked with the coupler 138, 198. When the proper holding assembly 94 is installed, the controller 242 indicates such to the operator.

Once the controller 242 informs the operator that the proper holding assembly 94 is installed, the operator slides the end of the roller tube assembly 18 into the holding assembly 94 as described hereinabove. When the roller tube assembly 18 is secured in the holding assembly 94, the roller tube is held in place to prevent rotation and the torsion rod is interconnected to the drive motor 100 for rotation therewith. The operator initiates winding and the controller 242 begins to rotate the drive motor 100. The drive motor 100 turns the gear reduction drive 108 and the associated drive shaft 110. The drive shaft 110 turns the input shaft 124, via the coupling 126, which turns the output shaft 128, via the pulleys 112, 114 and belt 116. The output shaft 128 turns the coupler 138, 198 which turns the torsion rod of the roller tube assembly 18. As the drive motor 100 rotates, the controller 242 counts the number of revolutions and stops the drive motor 100 at the home position after the proper number of revolutions have been completed. The drive motor 100 electronically brakes the assembly and locks it in the home position to prevent spontaneous unwinding.

When the proper number of revolutions have been completed, the controller 242 informs the operator to manually lock the roller tube assembly 18. The operator moves the lock assembly 42, 78 to the roll-up position. Additionally, the operator preferably installs a cotter pin between the end cap and the torsion rod for shipping purposes only because the lock assembly 42, 78 could be accidentally moved during shipping resulting in a loss of torque. Once the roller tube assembly 18 is locked, the operator initiates the controller 242 to back-up the drive motor 100 a small distance to remove any built-up tension. Note that the shape of the spring loaded lock tab 188, causes the tab 188 to be resilient when the drive motor 100 is operating in a reverse direction to prevent undesirable jamming of the lock 140 and end cap 32, 62. Once the tension is removed, the controller 242 informs the operator to remove the roller tube assembly 18 from the holding assembly 94. The operator, slides the roller tube assembly 94 across the top of the table 104 and out of the holding assembly 94. The torsion winder 90 is then ready for the next winding operation.

It can be seen from the above description that the method and apparatus of the present invention provides repeatable loading of the torsion springs in a simple manner for a more than one type of roller tube assembly 18. Additionally, the method and apparatus eliminates under and over torquing of the torsion springs. Furthermore a single torsion winder can be utilized with a variety of different awnings by having interchangeable holding fixtures 94.

Although particular embodiments of the invention have been described in detail, it will be understood that the invention is not limited correspondingly in scope, but includes all changes and modifications coming within the spirit and terms of the claims appended hereto.

What is claimed is:

1. A torsion winder for adding torsion to a roller tube assembly including a roller tube rotatable about a rod and a torsion spring between the roller tube and the rod, said torsion winder comprising:

a drive assembly including a drive motor;

a holding assembly secured to the drive assembly and including a coupler engageable with the rod to connect the rod to the drive motor for rotation therewith and a lock engageable with the roller tube to secure the roller tube against rotation; and a control system in communication with the drive motor and including a programmable logic controller.

2. The torsion winder according to claim 1, wherein said control system includes at least one proximity sensor in communication with said controller to identify the presence of said holding assembly.

3. The torsion winder according to claim 1, wherein said control system includes at least two proximity sensors in communication with said controller to identify the presence of interchangeable holding fixtures.

4. The torsion winder according to claim 1, wherein said control system includes a proximity sensor in communication with said controller to indicate a home position of said drive motor.

5. The torsion winder according to claim 1, wherein said controller is preprogrammed with limits for a number of revolutions the roller tube assembly can be turned.

6. The torsion winder according to claim 1, wherein said controller is preprogrammed with the appropriate holding assemblies for various models of the roller tube assembly.

7. The torsion winder according to claim 1, wherein said control system includes a bar code scanner in communication with said controller for imputing the model of the roller tube assembly into said controller.

8. The torsion winder according to claim 1, wherein said coupler interlockable with the rod to rotationally lock the coupler and the rod together and to allow longitudinally movement of the rod relative to the coupler.

9. The torsion winder according to claim 1, wherein said lock includes a spring loaded tab interlockable with the roller tube to substantially prevent rotation of the roller tube relative to the holding assembly and to allow longitudinal movement of the roller tube assembly relative to the holding assembly.

* * * * *